United States Patent [19]

Barbieri

[11] 4,125,954

[45] Nov. 21, 1978

[54] SPICE RACK CALENDAR

[76] Inventor: Joseph J. Barbieri, 1177 W. Olive #2, Sunnyvale, Calif. 94086

[21] Appl. No.: 841,456

[22] Filed: Oct. 20, 1977

Related U.S. Application Data

[63] Continuation-in-part of Ser. No. 703,835, Jul. 9, 1976.

[51] Int. Cl.[2] ..... G09D 3/02

[52] U.S. Cl. ..... 40/107; D6/114; D7/55

[58] Field of Search ..... 40/107, 111, 114, 109, 40/312; D19/21-23; D7/55; D6/114, 127

[56] References Cited

U.S. PATENT DOCUMENTS

| | | | |
|---|---|---|---|
| 247,000 | 9/1881 | Bath | 40/107 |
| 3,579,882 | 5/1971 | Miyahune | 40/107 |
| 3,670,436 | 6/1972 | Weissman | 40/107 |

*Primary Examiner*—John F. Pitrelli

[57] ABSTRACT

A spice rack calendar, enhanced by its devised compatibility with a conception to provide calendar visualization and innovative spice storage features; calendar indicia canisters with assured freshness capability; improved dispensing methods to simplify usage; flexibility to allow for convenience proximity; feasibility of use as a menu planner and general consumer appeal in the commercial market as an esthetic, practical, useful and functional product.

5 Claims, 8 Drawing Figures

GINGER
SALT
ANISE
CURRY
BASIL
MINT
CLOVE
SAGE
SAT
SUN MON TUE WED THU FRI
MACE
CHILI
GARLIC
CELERY
PEPPER
DILL
ONION
JAN
SEP

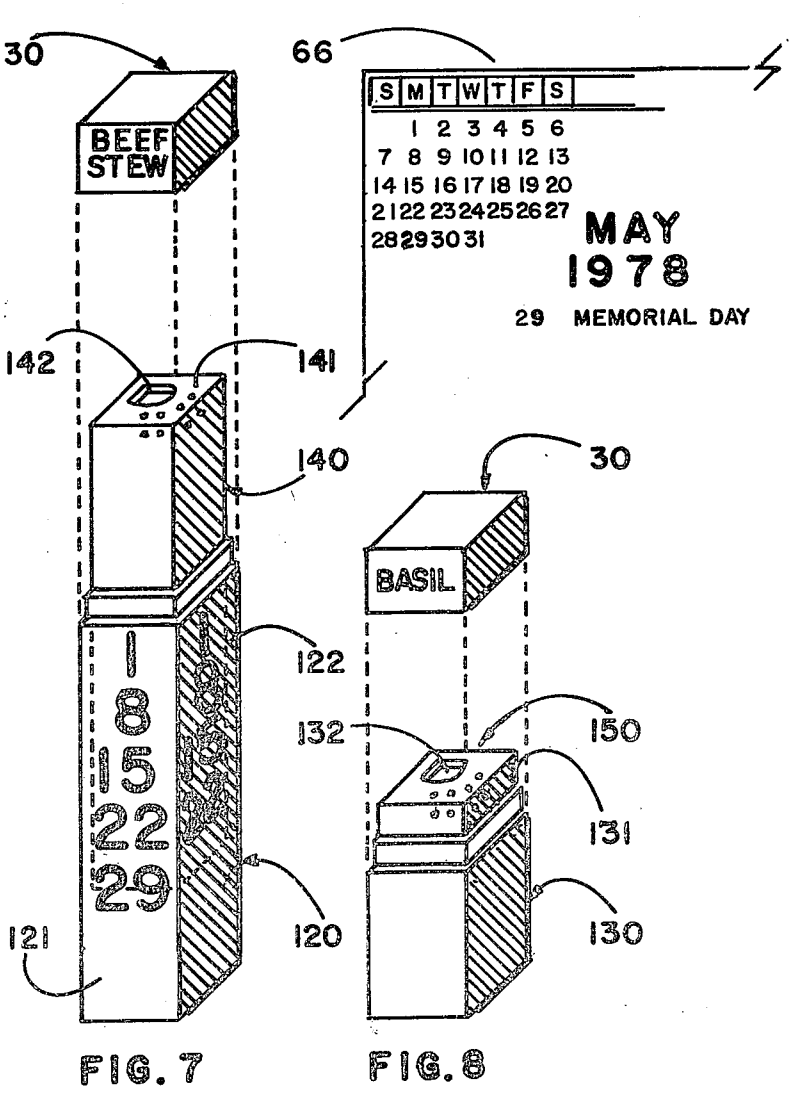
FIG. 7
FIG. 8
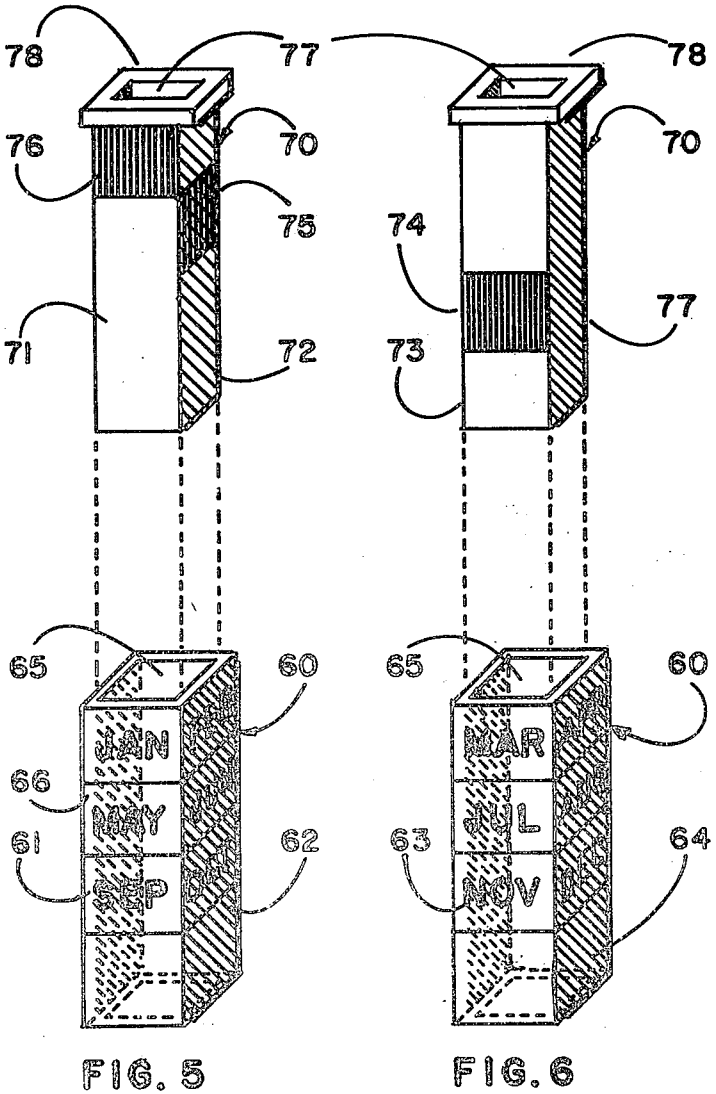
FIG. 5
FIG. 6

SPICE RACK CALENDAR

This is a continuation in part of my application, Ser. No. 703,835, filed July 9, 1976.

This invention comprises a wall hung spice rack calendar with the capability of instant removal and replacement. This is accomplished through the design of a wall hanger bracket. It is also a self standing rack and can be placed on any flat, level surface for regular kitchen use.

The construction material is optional for all pertinent parts. It can be manufactured of plastic, wood, metal, paper, cardboard or any material that is conductive to meeting the specified configurations of the product.

The spice rack receptacle can accomodate seven canisters, all of equal size and comprisng hollow columnar rectangular prisms, with calendar indicia on respective sides which are placed on correlating sequence to the seven days of the week indicia on the spice rack receptacle. Though these canisters may accept any and all spices, herbs, seasoned salts, seasoning recipe mixes, powdered gravies, powdered sauces, powdered salad dressings, etc; they are particularly conducive to the containment of seasoning recipe mixes for the purpose of menu planning. Supplementary recipe spices are accommodated below the calendar canisters. These smaller canisters; as do the calendar canisters, contain removable pour/shake dispenser inserts and air tight caps, which also serve as measuring devices for pouring purposes. An individual placement position is designated for a transparent, monthly set-up guide with the entire year in review. An insert with colored panels on different sides and at different levels indicates the prevailing month by correlating the background to the month.

This concept provides an alternate method of spice containment. As a means of achieving compatibility for its commercial potential, an innovative disposable refill is designed to fit exclusively into the calendar canister units. Filled with any and all spices, herbs, seasoned salts, seasoning recipe mixes, powdered gravies, powdered sauces, powdered salad dressings, etc., they are designated as an integral part of the spice rack calendar concept. Another compatible unit is that of a disposable canister, similar to the supplementary spice canisters, except that the dispenser is sealed to the unit, rendering it incapable of refilling and consequently, disposable.

The seven calendar canisters are to arranged correspondingly to the set-up guide for the current month. A simple rotation of each calendar canister to the face out position before inserting it into the proper day of the week receptacle will produce the particular month desired. The caps must then be rotated face out to identify the spices, herbs, seasoned salts, seasoning recipe mixes, powdered gravies, powdered sauces, powdered salad dressings, etc.

The object of the invention and its advantages will become more apparent from the following description, taken in conjunction with the appended drawings in which:

BRIEF DESCRIPTION OF THE DRAWING

In the accompanying drawing which forms a part of the specification:

FIG. 5 is a perspective view of a monthly set-up guide with an insertable monthly indicator shown in a first position;

FIG. 6 is a perspective view of a monthly set-up guide similar to FIG. 5, with an insertable monthly indicator shown in a second position;

FIG. 7 is an expanded perspective view of a calendar canister; and

FIG. 8 is a perspective view of a supplementary spice canister.

FIG. 1 is an overall perspective view of the spice rack calendar receptacle 10 in self standing position. The calendar canisters are set to represent a typical month of thirty-one days, as indicated on the transparent monthly set-up guide 60; and specifically noted in detail 66. The month of May takes prominence by inserting unit 70 with mid-level background 75, on side 72 (FIG. 5) thus exposed. The receptacle includes a retaining wall member 14 which functions to retain the calendar canisters in place. The wall 14 has days of the week indicia thereon correlated to the calendar canisters with the exception of canister 20; removed to reveal a typical divided opening 16 and provide further description in FIGS. 2 and 3. Each calendar canister is topped with an air tight cap 30 also comprising a rectagular prism, as are the supplementary spice canisters 130 (FIG. 8) shown on lower receptacle shelf 11 with opening space 15 for prospective logo indicia. Dotted lines 12 reveal back side construction, particularly the guiding back slots 17 which drop over bracket prongs 52 (FIG. 4) for purpose of mounting the spice rack calendar on a wall.

FIG. 2 is a perspective view of calendar canister 20, revealing the position of calendar indicia on side 22 as related to side 21, for months with thirty-one days. The contents indicia on cap 30, side 31 and side 32, are selectively versatile for preference of spice containment.

FIG. 3 is a component perspective view of calendar canister 20, revealing the position of calendar indicia on side 24 as related to side 23 for months with days fewer than thirty-one. A removable pour/shake dispenser insert 40 with spout 42 for pouring functions and holes 41 for shaking functions, fits snugly into canister opening 25 with just enough protrusion to form an artight contact inside of cap 30. Cap side 33 and cap side 34 again bear varied contents indicia for versatility of spice selection. It should be noted that the removable pour/-shake dispenser insert 40 is also adaptable to supplementary spice canister 130.

FIG. 4 is a perspective view of the wall hanger bracket in position for engaging the back slots 17 down over bracket prongs 52 which provides for quick and easy secure mounting; and also, quick and easy removal for self standing work proximity. Holes 51 are counter sunk for unobstructed mounting.

FIG. 5 is a perspective view of the transparent, monthly set-up guide 60 and its insertable monthly indicator 70. Sides 61 and 62 show the monthly indicia of six selected months at three different levels which coincide with the three different background levels, 76, side 71; level 75, side 72; and level 74, side 73 (FIG. 6). The insert 70, must be placed accordingly to pronounce the prevailing month. The monthly set-up guide 60 is an annual, replaceable unit which provides the set-up for all twelve months of the year, presented in review on twelve individual sections with the year and month indicia as well as the notation of holidays; typified here as the month of May and identified by numeral 66 and enlarged to show detail. Ledge 78 provides for flush fit of indicator 60 and opening 77 facilitates removal of units 60 and 70 with all sides in tandem.

FIG. 6 is a perspective view of the other two sides 63 and 64 of the transparent monthly set-up guide 60; the placement of the other six months on unit 60; and side 73 on insert 70 with bottom level background 74. Side 77 is non functional and contains no background panel. All other pertinent descriptions are similar to those previously defined.

FIG. 7 is an expanded perspective view of a calendar canister 120 with a comparison of calendar indicia on side 121 for set-up of months with twenty nine days or more; and side 122 for the month of February which has only twenty eight days, exclusive of leap year. Disposable refill 140 is shown protruding from calendar canister 120. When fully inserted, it extends just enough to form an airtight contact inside of cap 30. The pour spout 142 and shaker holes 141 are integral parts of refill 140 and are of a one piece fabrication.

FIG. 8 is a perspective view of the supplementary spice canister 130 with sealed on dispenser unit 150, though still retaining the same features, pour spout 132 and shaker holes 131. The top 30 remains the same in design and function in all versions of canisters and refills.

Figures 1, 2, 3, 4:
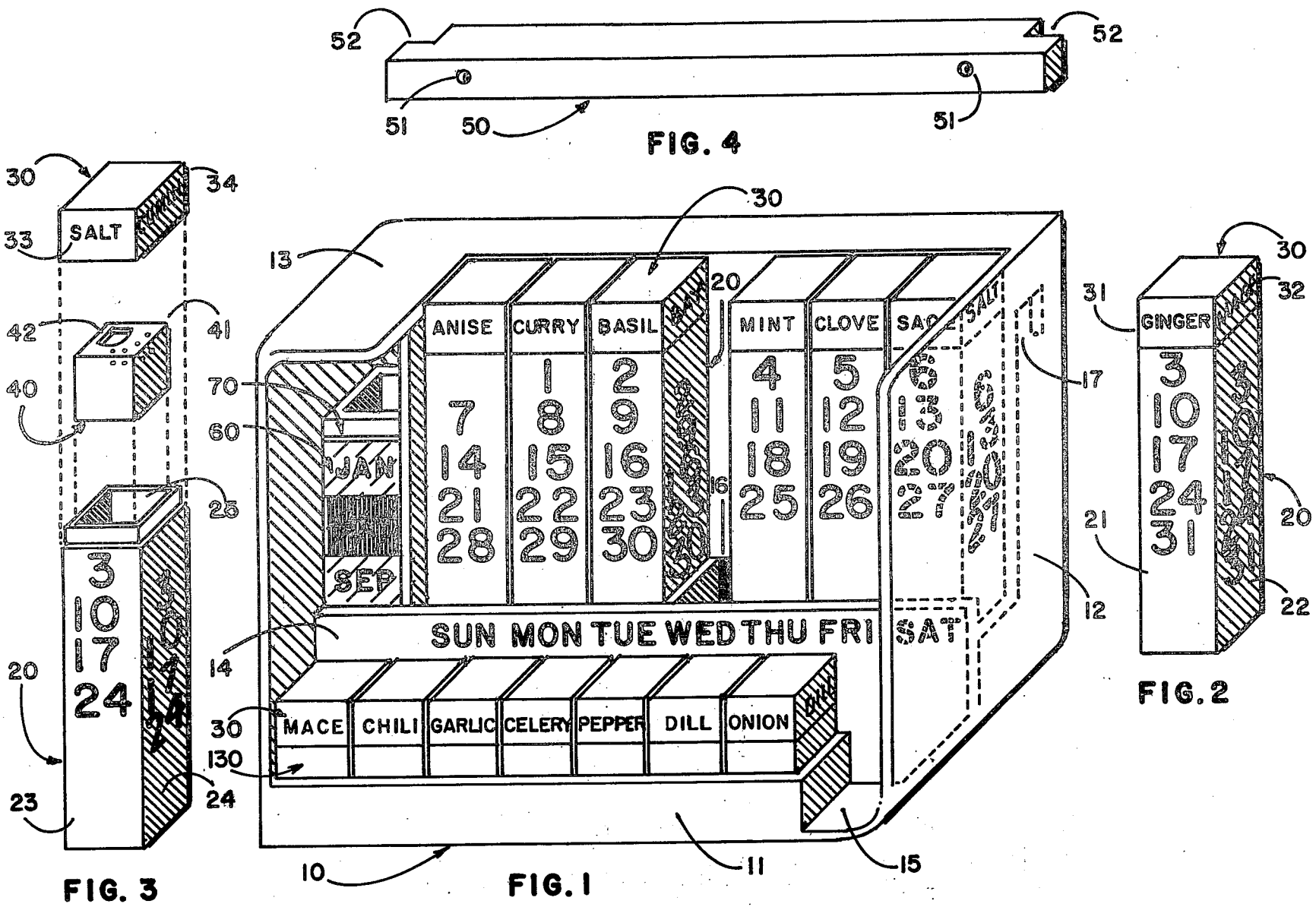
FIG. 1 is an overall perspective view of the spice rack calendar receptacle in self standing position.
FIG. 2 is a perspective view of a calendar canister.
FIG. 3 is a component perspective view of a calendar canister.
FIG. 4 is a perspective view of a wall hanger bracket.

While the preferred embodiment of various aspects of the invention have been shown in the drawings, it is to be understood that this disclosure is for illustration only in that various changes in shape, proportion and arrangement of parts, as well as the substitution of equivalent elements for those herein shown and described, may be made without departing from the spirit and scope of the invention as set forth in the appended claims.

I claim:

1. A combination spice rack calendar comprising a self-standing spice rack receptacle having auxiliary wall mounting means associated therewith; seven hollow columnar rectangular prisms each having calendar day indicia on plural sides thereof whereby said prisms may be interchangeably arranged to display day indicia of a given month of the year; each said prism further comprising an airtight cap associated therewith whereby said prisms may function as spice canisters; said cap also comprising a rectangular prism and having indicia relating to contents on plural sides thereof; an indicator capsule comprising a rectangular prism including month indicia on plural sides thereof and means associated therewith to identify the given month, being displayed; said receptacle further comprising a retaining wall member having day of the week indicia thereon and functioning to retain said seven calendar canister prisms and said indicator capsule in said receptacle.

2. A combination spice rack calendar according to claim 1, wherein said auxiliary wall mounting means comprises a wall hanger bracket and slots in the rear wall of said receptacle designed for mating cooperation with said bracket.

3. A combination spice rack calendar according to claim 1, further comprising a combination pour and shake dispenser which may be removably inserted in said calendar canister prisms and retained therein by said caps; said dispenser comprises a rectangular prism having several small holes adjacent one of the top corners thereof whereby said dispenser may function as a shaker and a spout adjacent a top corner opposite from said one corner whereby said dispenser may perform pouring functions.

4. A combination spice rack calendar according to claim 1, further comprising supplementary spice canisters of similar configuration to said calendar canisters prisms; said supplementary spice canisters do not include calendar indicia and are mounted in the lower portion of said receptacle.

5. A combination spice rack calendar according to claim 1, wherein said indicator capsule comprises a hollow transparent rectangular prism having three different months of the year arranged vertically at three different levels and displayed on each side thereof; said month identification means comprises an insert member of rectangular prism configuration having background shading at three different levels on three sides thereof whereby one particular month will be highlighted when said member is inserted in said capsule and said shading aligns with said month indicia.

* * * * *